United States Patent [19]

Fraser

[11] Patent Number: 5,028,027

[45] Date of Patent: Jul. 2, 1991

[54] SUPPORT FOR A CURTAIN OR THE LIKE

[75] Inventor: Thomas A. Fraser, Old Rectory, United Kingdom

[73] Assignee: Textile Innovations Limited, St. Helier, Channel Islands

[21] Appl. No.: 473,460

[22] Filed: Feb. 1, 1990

[30] Foreign Application Priority Data

Feb. 9, 1989 [GB] United Kingdom ..... 8902865

[51] Int. Cl.[5] ..... A47H 1/10

[52] U.S. Cl. ..... 248/262; 160/330; 160/352

[58] Field of Search ..... 160/132, 130, 330, 352; 248/261, 262, 254

[56] References Cited

U.S. PATENT DOCUMENTS

| | | | |
|---|---|---|---|
| 1,313,915 | 8/1919 | Robinette | 248/254 |
| 1,406,311 | 2/1922 | Wendel | 248/261 X |
| 1,518,963 | 12/1924 | Civis | 248/262 |
| 2,261,142 | 11/1941 | Davis | 160/352 X |
| 2,266,854 | 12/1941 | Davis | 160/352 X |
| 3,064,724 | 11/1962 | Nowell | 160/330 |
| 3,140,071 | 7/1964 | Lorentzen | 248/262 X |
| 3,346,227 | 10/1967 | Hankin | 248/262 |

*Primary Examiner*—David M. Purol

*Attorney, Agent, or Firm*—Fisher, Christen & Sabol

[57] ABSTRACT

A support for hanging fabric has a straight portion and a curved portion. These define a close loop shape. The straight portion may be of strip form and in two parts connectable and disconnectable by a connector. The two parts forming the joint are supported by a bracket fixable to a substantially vertical surface. The bracket has upper and lower opposed U-shape channel portions, the bracket being constructed and arranged to be capable of retaining the two parts within the bracket. The connector may be a dovetail joint.

7 Claims, 2 Drawing Sheets

SUPPORT FOR A CURTAIN OR THE LIKE

BACKGROUND OF THE INVENTION

Field of the Invention

This invention relates to a support for a hanging fabric such as a curtain or the like.

According to the invention, there is provided a support for a hanging fabric having a straight portion and a curved portion together defining a closed loop shape, at least the straight portion being of strip form and in two parts connectable and disconnectable by a connection means (e.g. a dovetail joint), the two parts forming the joint being supported by a bracket fixable to a substantially vertical surface and having upper and lower opposed U-shaped channel portions, the bracket being constructed and arranged to be capable of retaining the said two parts within the bracket.

In a preferred embodiment of the invention, the bracket has one or more screw holes whereby it can be secured to a wall or other vertical surface. Each of the said two parts is preferably made of a substantially flat strip. Each may have a dimpled portion whose shape is approximately complementary to a head of a screw or bolt. With this arrangement, the co-operation between the screw or bolt heads and the dimpled portions tend to maintain the said two parts within the bracket. The screws or bolts referred to are those used to secure the bracket to a wall or the like.

The support is preferably made of aluminium or aluminium alloy, but other materials, e.g. steel or synthetic plastics materials, may be suitable in some circumstances. Similar materials may be used for the bracket. The invention is not limited to any particular materials.

BRIEF DESCRIPTION OF THE DRAWING FIGURES

The invention will be better understood from the following non-limiting description of an example thereof given with reference to the accompanying drawings in which.

DESCRIPTION OF THE PREFERRED EMBODIMENTS

One important use of the invention is for supporting curtains or pelmets or other fabric hangings over the head portions of beds. Currently available arrangements for this purpose tend to be more elaborate and complicated to install.

Figure 1:
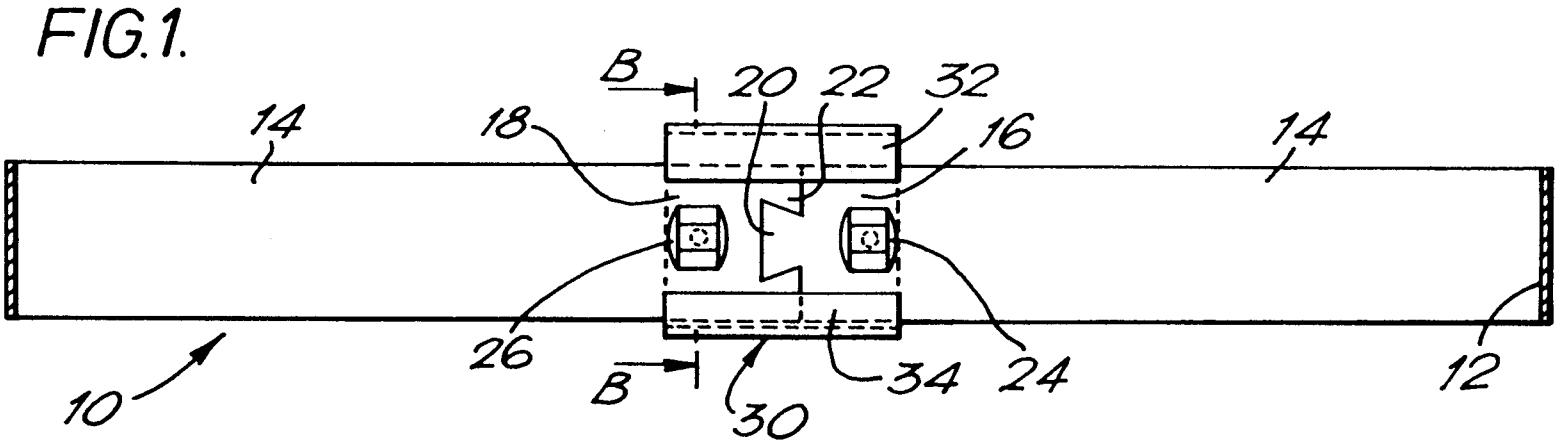
FIG. 1 is a front elevation view looking in the direction A—A of FIG. 2.
Figure 3:
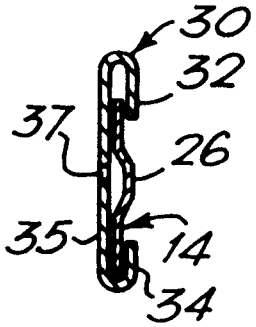
FIG. 3 is a sectional view showing the support band supported by a bracket, taken on the line B—B of FIG. 1.
Figure 2:
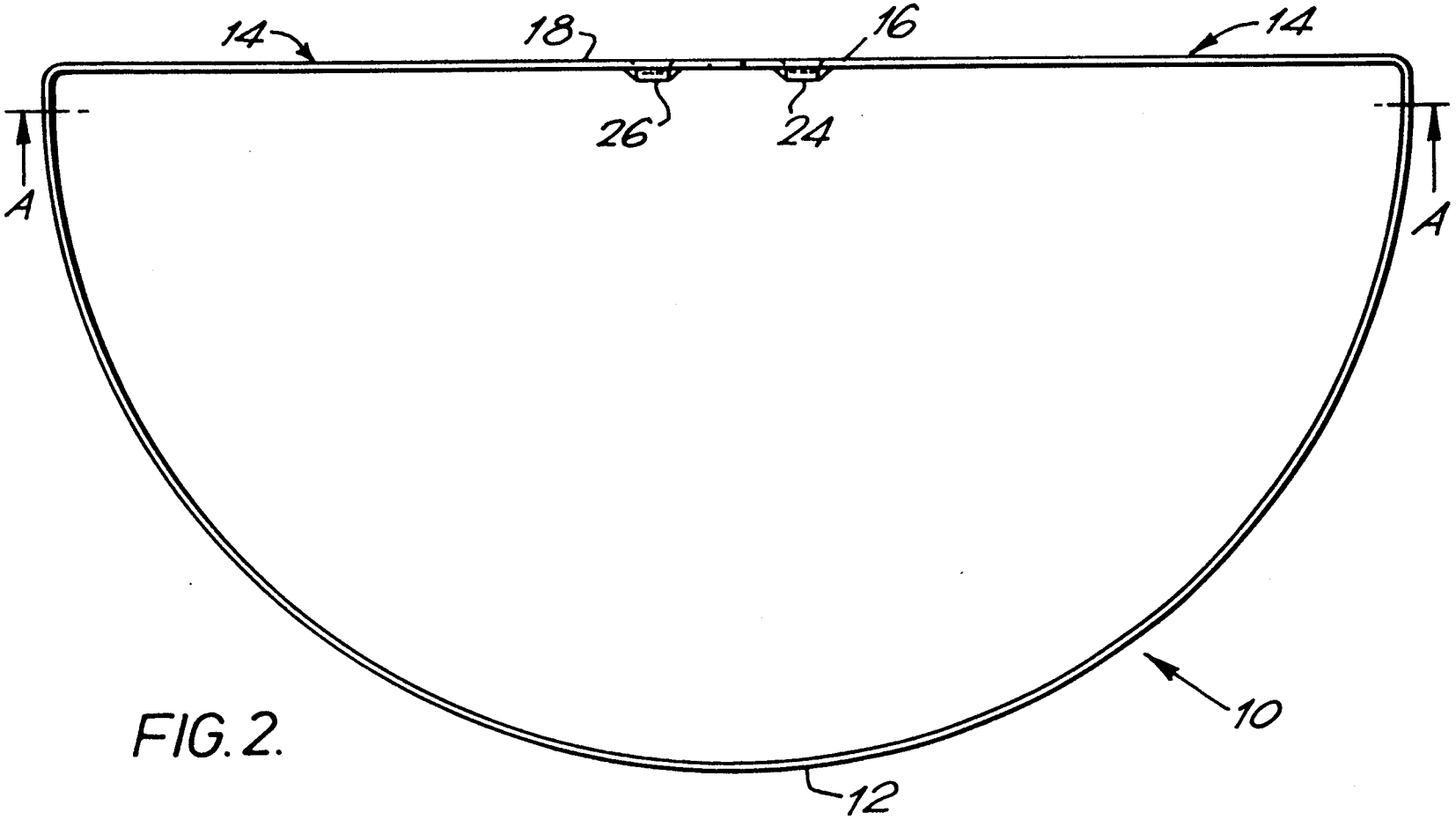
FIG. 2 is a plan view of one example of a support in accordance with the invention.

The illustrated support for hanging fabric includes a metal curtain band 10 (FIGS. 1 and 2) which has an arcuate portion 12 and a straight portion 14. The straight portion 14 is made up of two parts 16 and 18. The parts 16 and 18 have their ends respectively shaped as male and female dovetails 20 and 22. These ends are dimpled as seen respectively at 24 and 26 in FIG. 1; the dimpling shape is seen at 26 in FIG. 3.

The band 10 is supported by a bracket 30 which has upper and lower opposed U-shaped channel portions 32 and 34 connected by a web 35. The web 35 has two holes 37 and 38 therethrough to receive respective screws or bolts 40, 42 by which the bracket 30 is attached to a vertical support surface such as a wall or post.

Figure 5:
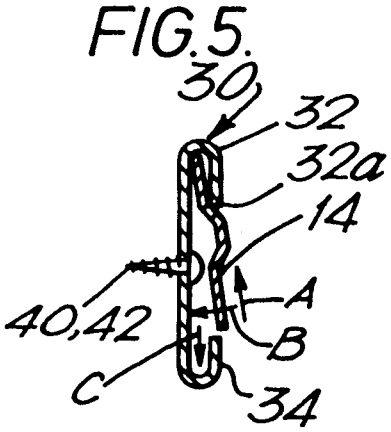
FIG. 5 is a diagrammatic view illustrating the manner of assembly of the band and bracket to produce the completed support for hanging fabrics.
Figure 4:
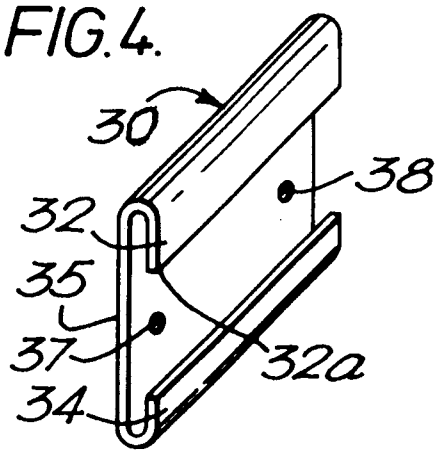
FIG. 4 is a perspective view showing one example of bracket.

In operation, the band 10 is separated at the dovetail joint and fabric such as a curtain or a pelmet is threaded or looped onto the band. The two ends of parts 16 and 18 are then joined by closing the dovetail joint. The so-joined strip portions are then inserted into the bracket 30 in the manner diagrammatically indicated in FIG. 5. That is to say, firstly the straight portion 14 is lifted as shown by the arrow A so that its upper edge is received within the downwardly open U-shaped channel portion 32, then the band 10 is tilted (arrow B) towards an orientation in which its cross-section appears substantially vertical and the loop made by the band 10 is located substantially in a generally horizontal plane. Finally the band 10 is moved vertically downwards (arrow C) so that its lower edge is supported by and sits in the upwardly open U-shaped channel portion 34 and its upper edge is retained by the overhanging part **32*a* of the channel portion 32 and so is maintained captive within the bracket 30. Of course it can be withdrawn from the bracket 30** by making a converse series of movements.

It will be seen that both erection and assembly of the curtain support according to the illustrated embodiment of the invention is readily accomplished without difficulty by unskilled personnel. Moreover, the whole arrangement can be supported merely by two screws or bolts. The support for fabric disclosed herein is hence well suited to the domestic "do-it-yourself" market.

It will be appreciated that modifications can be made without departing from the invention. For example it is not absolutely essential to the invention that the joint should be a dovetail type of joint. Interconnected S-shaped hooks or interconnected L-shaped hooks could be equally satisfactory and suitable in some applications. Although the bracket is shown as relatively short in length compared to the straight portion 14 of the band 10, the invention is clearly not limited to the use of a bracket of any particular length, nor to a bracket or a band of any particular material. While it is preferred that the bracket should have upper and lower substantially U-shaped channel portions, it will be appreciated that other shapes of bracket may be equally suitable. For example, adequate results could be obtained by having a bracket with rectangular shaped channel portions. When the support is retained within a bracket constituted by a rectangular shaped channel portion, a cover may be fitted over the bracket to help hold the support together. While the illustrated embodiment is made from a single strip of metal which can be joined by a suitable connection means at its ends, most of the advantages of the invention could be obtained by having a band 10 made up of separate parts 12 and 14 joined together at the ends of the arcuate portion in any suitable manner. Other variations may occur to a one of ordinary skill in the art and the intention of the present patent application is to cover all such modified and equivalent arrangements.

What is claimed is:

1. A support for hanging fabric, the support having a straight portion and a curved portion together defining a closed loop shape, at least the straight portion being of strip form and having two parts connectable and disconnectable by a connection means, the two parts of the strip forming a joint being supported by a bracket fixable to a substantially vertical surface, said bracket having upper and lower opposed U-shaped channel portions, the bracket being constructed and arranged to retain the said two parts within the bracket.

2. A support according to claim 1 in which the bracket has one or more screw holes whereby said bracket can be secured to a wall or other vertical surface.

3. A support according to claim 1 in which each of said two parts is made of a substantially flat strip.

4. A support according to claim 3 in which each of said two parts has a dimpled portion whose shape is complimentary to a head of a screw or a bolt.

5. A support according to claim 1 in which the bracket comprises a rectangular shaped channel portion and a cover member to retain the support within said rectangular shaped channel portion.

6. A support according to claim 1 in which the connection means is a dovetail joint.

7. A support for a hanging fabric which is to constitute a curtain over a bed-head, the support comprising:

a straight strip portion, a curved strip portion which together with the straight strip portion defines a closed loop shape from which said curtain may be suspended, the straight portion being in two parts, connectible and disconnectible by a dovetail form, to provide a joint when said two parts are connected.

a bracket for supporting the two parts of said straight portion when said two parts are connected, the bracket being located at and partially overlapping said joint formed by the connection of the two parts;

the bracket further having upper and lower U-shaped channel portions for retaining the straight strip portion within the bracket.

* * * * *